US011554287B2

(12) United States Patent
Parsian et al.

(10) Patent No.: US 11,554,287 B2
(45) **Date of Patent: *Jan. 17, 2023**

(54) EXERCISE MACHINE CONNECTOR

(71) Applicant: Tonal Systems, Inc., San Francisco, CA (US)

(72) Inventors: Mohammadali Parsian, San Mateo, CA (US); Dana Robert Nicholson, Lafayette, CA (US); Aly E. Orady, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/173,673

(22) Filed: Feb. 11, 2021

(65) Prior Publication Data

US 2021/0236877 A1 Aug. 5, 2021

Related U.S. Application Data

(63) Continuation of application No. 16/370,350, filed on Mar. 29, 2019, now Pat. No. 10,960,258.

(60) Provisional application No. 62/650,127, filed on Mar. 29, 2018.

(51) Int. Cl.

| | |
|---|---|
| ***A63B 21/00*** | (2006.01) |
| ***A63B 23/12*** | (2006.01) |
| ***A63B 23/035*** | (2006.01) |

(52) U.S. Cl.

CPC ..... *A63B 21/4035* (2015.10); *A63B 21/151* (2013.01); *A63B 23/03525* (2013.01); *A63B 23/1209* (2013.01); *A63B 2209/00* (2013.01)

(58) Field of Classification Search

CPC ..... A63B 21/4035; A63B 37/0097; A63B 21/4017; A63B 21/151; A63B 23/03525; A63B 23/1209; A63B 2209/00; A63B 71/0036; A63B 71/0054; A63B 2209/02; A63B 2225/09; F16B 21/04; F16B 21/02; F16B 21/09

See application file for complete search history.

(56) References Cited

U.S. PATENT DOCUMENTS

| | | | | |
|---|---|---|---|---|
| 4,742,703 | A * | 5/1988 | DeWalch | E05B 21/066 70/366 |
| 5,665,040 | A | 9/1997 | Ho | |
| 5,779,601 | A * | 7/1998 | Ish, III | A63B 23/03566 482/102 |

(Continued)

FOREIGN PATENT DOCUMENTS

| | | |
|---|---|---|
| CN | 1541732 | 11/2004 |
| CN | 2676959 | 2/2005 |
| EP | 3054191 | 4/2018 |

OTHER PUBLICATIONS www.lexico.com/en/definition/key; Jun. 18, 2020.

*Primary Examiner* — Andrew S Lo
*Assistant Examiner* — Andrew M Kobylarz
(74) *Attorney, Agent, or Firm* — Van Pelt, Yi & James LLP

(57) ABSTRACT

An exercise machine component comprises a cable connection base adapted to attach to an end of a cable, a chamber adapted to receive a key through an opening of the chamber, a biasing mechanism within the chamber, and a receiving groove within the chamber wherein the biasing mechanism biases the key against the receiving groove so that the key is securely fixed within the chamber.

19 Claims, 13 Drawing Sheets

(56) References Cited

U.S. PATENT DOCUMENTS

| | | | | |
|---|---|---|---|---|
| 6,447,430 | B1 * | 9/2002 | Webb | A63B 21/154 482/93 |
| 6,692,416 | B1 * | 2/2004 | Davis | A63B 21/4035 482/44 |
| 7,137,914 | B1 * | 11/2006 | Boyer | A63B 43/007 473/575 |
| 7,883,452 | B1 * | 2/2011 | Chen | A63B 21/072 482/93 |
| 8,197,155 | B2 | 6/2012 | Noh | |
| 8,870,722 | B2 * | 10/2014 | Kassel | A63B 21/4015 482/121 |
| 2006/0111221 | A1 | 5/2006 | Williams | |
| 2009/0208281 | A1 * | 8/2009 | Noh | B60T 11/046 403/349 |
| 2011/0240403 | A1 | 10/2011 | Meillet | |
| 2012/0202657 | A1 * | 8/2012 | Wang | A63B 21/151 482/122 |
| 2014/0270924 | A1 | 9/2014 | Savarino | |
| 2020/0047027 | A1 | 2/2020 | Ward | |
| 2020/0047030 | A1 | 2/2020 | Ward | |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054929 | A1 | 2/2020 | Ward | |

* cited by examiner

EXERCISE MACHINE CONNECTOR

CROSS REFERENCE TO OTHER APPLICATIONS

This application is a continuation to U.S. patent application Ser. No. 16/370,350 entitled EXERCISE MACHINE CONNECTOR filed Mar. 29, 2019, which claims priority to U.S. Provisional Patent Application No. 62/650,127 entitled TRAINING MACHINE BALL STOP filed Mar. 29, 2018, both of which are incorporated herein by reference for all purposes.

BACKGROUND OF THE INVENTION

Strength training, also referred to as resistance training or weight lifting, is an important part of any exercise routine. It promotes the building of muscles, the burning of fat, and the improvement of a number of metabolic factors including insulin sensitivity and lipid levels. Many users seek a more efficient and safe method of strength training, thus driving a need for mechanical components providing these features.

BRIEF DESCRIPTION OF THE DRAWINGS

Various embodiments of the invention are disclosed in the following detailed description and the accompanying drawings.

DETAILED DESCRIPTION

Figure 1:
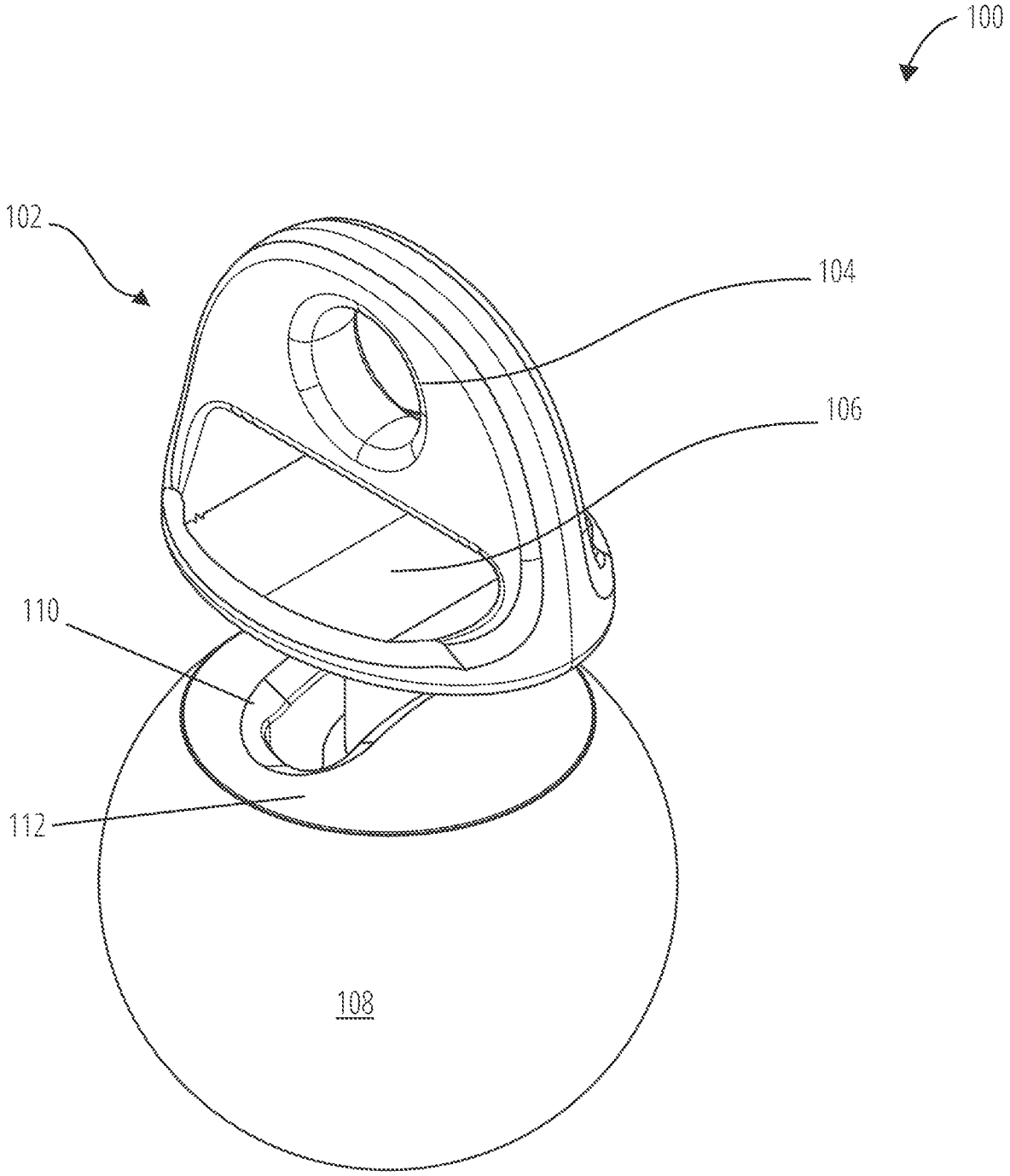
FIG. 1 illustrates a perspective view of an embodiment of an exercise machine connector.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention.

Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Many exercise machines comprise a cable extending from the machine utilized to perform exercises, sometimes referred to as a cable based exercise. Some machines comprise one or more arms and/or guides from which the cable extends. In an exemplar cable based exercise machine, each arm is between 2 and 5 feet long, for example 3 feet long, and made of rigid material, for example steel, may weigh up to 25 lbs, for example 10 lbs.

In order to prevent the cable from retracting back into the machine, arm, and/or guide, an exercise machine connector including a cable connection base, stop or in some embodiments, a "ball stop" is attached to the user's end of the cable. The connector may be substantially spherical in shape, like a ball or a flexible ball. Using this cable connection base to include safe and secure attachment points for connecting to user actuators such as a carabiner, strap, handle, bar, dual handles, pull-down bar, and/or rope to perform various exercises is disclosed. Enabling convenient detachment of these actuators from the cable connection base is disclosed. Thus, a cable connection base that is easy and/or efficient for a user to attach and detach actuators yet safe to prevent sudden release is disclosed.

In one embodiment, the detachable coupling of the attachment point may operate wherein the ball extrudes a male flat rigid piece with a hole in it. This piece snaps into a spring-loaded connector that is attached to the actuator, for example, a handle or bar. The hole traps the connector with a snap and this connection acts as a lock. To unlock the connector from the ball, the user may push down the button on the connector to disengage the end snap and to allow the rigid piece to disengage from the connector. The hole in the male flat rigid piece also may serve as an attachment point for a carabiner to allow a non-compatible handle to be used.

In one embodiment, the detachable coupling of the attachment to the cable connection base is achieved by a spring-loaded mechanism in the cable connection base that receives a male T-shaped portion of an actuator connector. The T-shaped portion snaps into the cable connection base and an actuator such as a handle or bar is attached to the actuator connector. The mechanism traps the connector with a snap and this connection acts as a lock. To unlock the connector from the cable connection base, the user may push the connector and rotate the connector against the mechanism.

In a preferred embodiment, the detachable coupling of the attachment point may operate in a lock and key configuration, where the attachment point on the actuator, or key, includes an extended and/or cylindrical linkage/bar that is inserted into a chamber adapted to receive a key through an opening of the chamber, groove, or keyhole, of the cable connection base body. The chamber may be open on one or more sides. The key may be received via a slot. In a preferred embodiment, the key is a T-shaped linkage/bar that permits a degree of freedom in one dimension to swivel around the top member of the "T" of the T-shaped linkage/bar. In another embodiment, the key is an extended X-shaped linkage/bar when degrees of freedom are minimized.

The chamber adapted to receive the key may be part of a cage structure and/or a rigid cage that resides within the body of the cable connection base and includes a biasing mechanism within the chamber, such as a spring or set of springs. In one embodiment, a cap plate covers the key-side of the spring to protect the spring from being entangled. In another embodiment, no cap plate is required to simplify the mechanism. The key may be locked in place by pushing down on against the biasing mechanism and then rotating the key, for example by 90 degrees. The connector has a receiving groove within the chamber wherein the biasing mechanism biases the key against the receiving groove so that the key is securely fixed within the chamber. For example, after the key is rotated, the biasing mechanism, for example through elasticity of a spring, may retain the key in place by pushing the key against a stop such as a recess, preventing it from disengaging unless it is pushed down and rotated back in the opposite direction. An actuator may be coupled to the cable connection base to operate components on the arm or exercise machine.

As shown in the following figures, an exercise machine connector with lock and key configuration is an example of an exercise machine component that permits the attachment of various actuators such as a carabiner and a strap, dual handles, single handle, pull-down bar, and so forth, in order to perform various cable based exercises.

FIG. 1 illustrates a perspective view of an embodiment of an exercise machine connector. The exercise machine connector (100) includes a key (102) and a cable connection base (108). The key (102) may operate as a coupling point between cable connection base (100) and various attachments and/or actuators.

In one embodiment, the key (102) includes an eyelet (104) and/or a strap mount (106). The eyelet (104) may provide a permanent or semi-permanent attachment point for an actuator, for example by using a carabiner or flexible load-bearing mechanism such as a cable, rope, strap or wire. The strap mount (106) may provide a slit through which a strap can be threaded through. In another embodiment, the key (102) may include a tube for holding a rope, or any other such attachments typically used for exercise. The key (102) may traverse through a keyhole (110) of a cage (112) positioned within the ball (108). In some embodiments, an eyelet is not included so that a smooth surface is provided to facilitate twisting the key.

Figure 2:
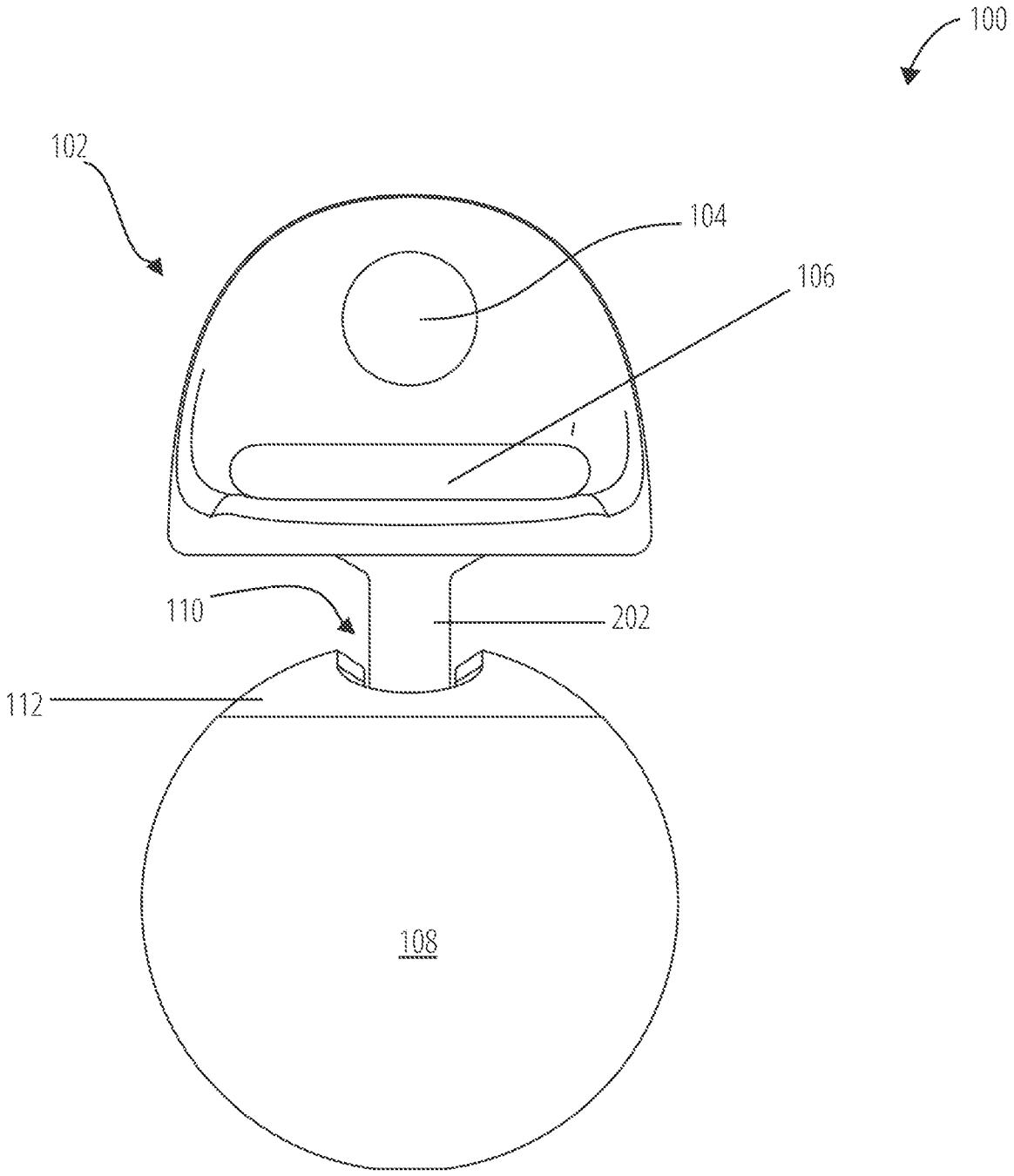
FIG. 2 illustrates a front view of an embodiment of an exercise machine connector.

FIG. 2 illustrates a front view of an embodiment of an exercise machine connector. In one embodiment, the same components as shown in FIG. 1 are shown in FIG. 2 from a different perspective. As in FIG. 1, the exercise machine connector (100) includes a key (102) and a cable connection base (108). The key (102) includes an eyelet (104) and/or strap mount (106), as well as a neck (202) of the keying mechanism. The neck (202) is coupled to the base (108) through a keyhole (110) of a cage (112).

Figure 3:
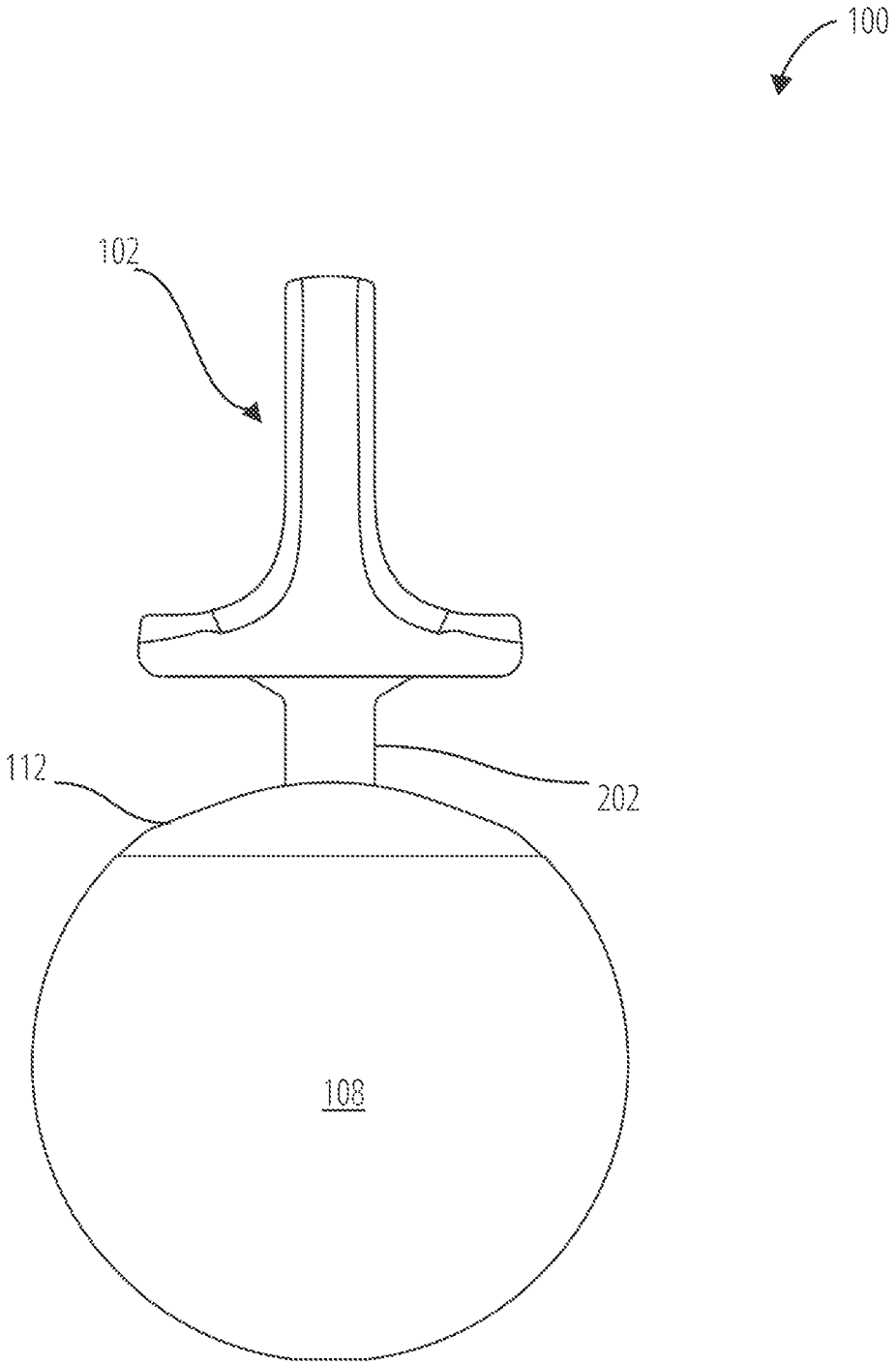
FIG. 3 illustrates a lateral view of an embodiment of an exercise machine connector.

FIG. 3 illustrates a lateral view of an embodiment of an exercise machine connector. In one embodiment, the same components as shown in FIG. 2 are shown in FIG. 3 from a different perspective. As in FIG. 2, the exercise machine connector (100) includes a key (102) and a cable connection base (108). The key (102) includes a neck (202) of the keying mechanism. The neck (202) is coupled to the base (108) through a keyhole of a cage (112).

Figure 4:
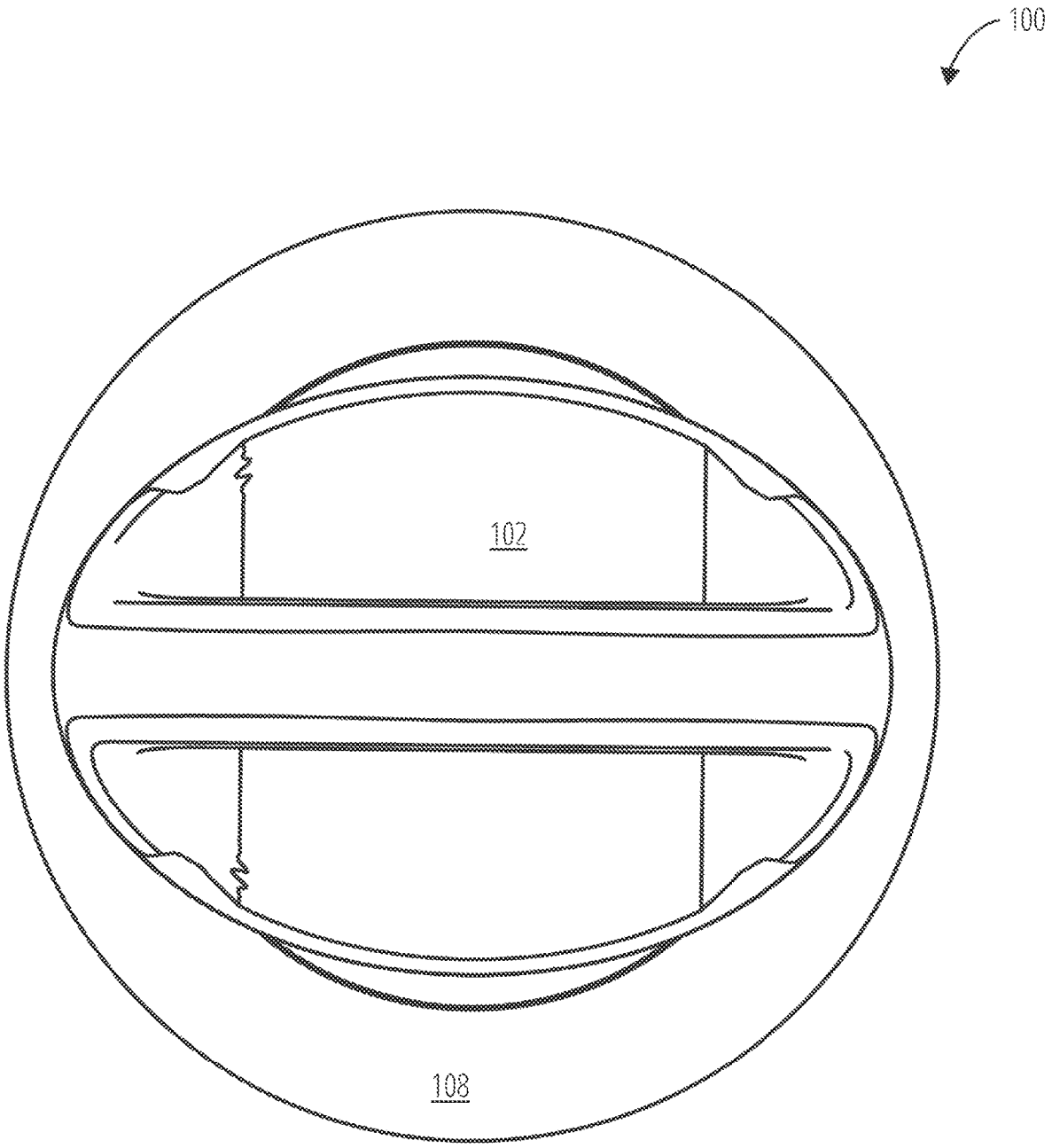
FIG. 4 illustrates a top view of an embodiment of an exercise machine connector.

FIG. 4 illustrates a top view of an embodiment of an exercise machine connector. The same components as shown in FIG. 2 are shown in FIG. 4 from a different perspective. As in FIG. 2, the exercise machine connector (100) includes a key (102) and a cable connection base (108).

Figure 5:
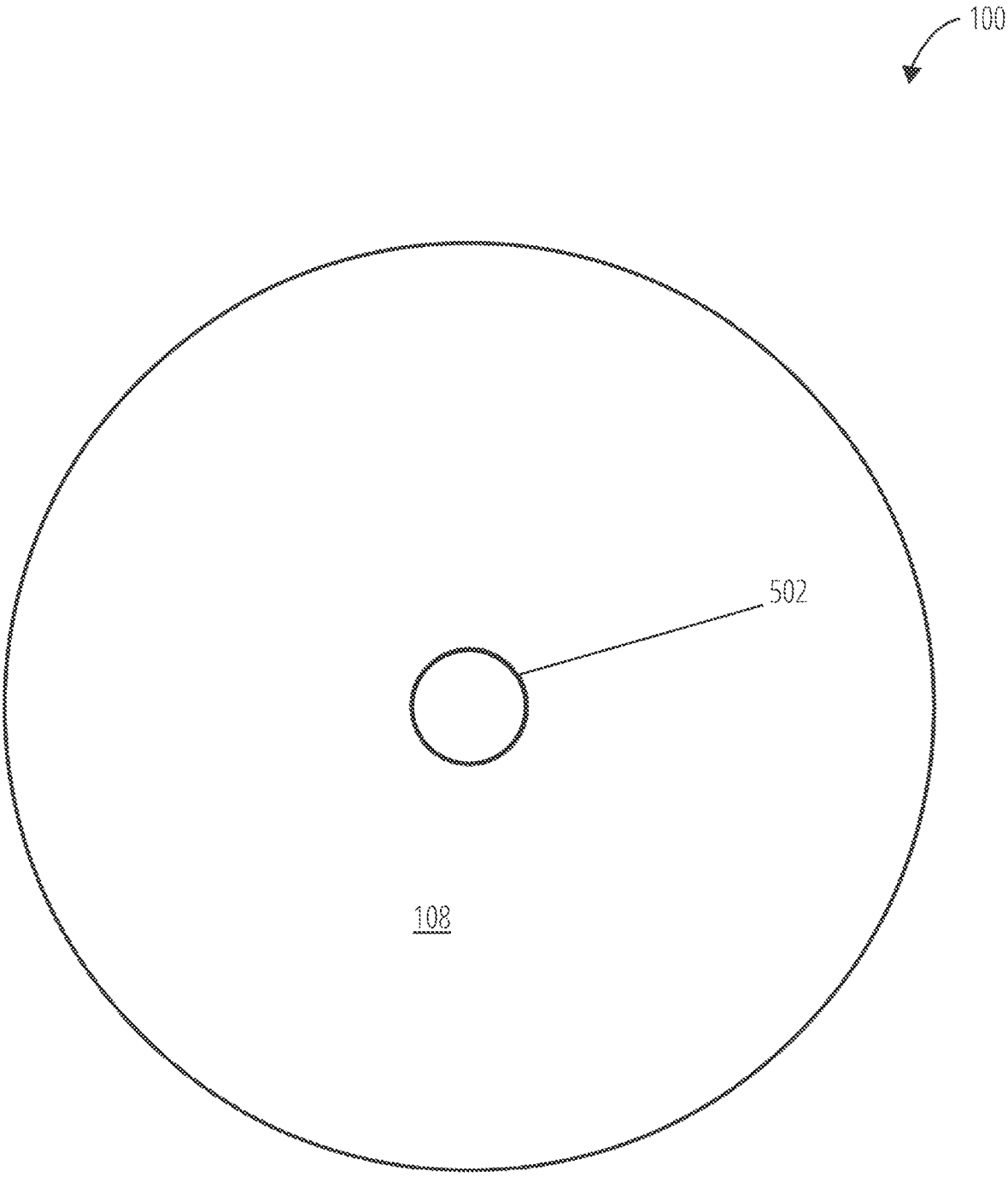
FIG. 5 illustrates a bottom view of an embodiment of an exercise machine connector.

FIG. 5 illustrates a bottom view of an embodiment of an exercise machine connector. From this perspective, the cable connection base (108) is shown to include a cable slot (502) on the bottom of the base (108). The base (108) internally may provide a mounting point for a cable and cable knot. The cable may be threaded by way of the cable slot (502).

Figure 6:
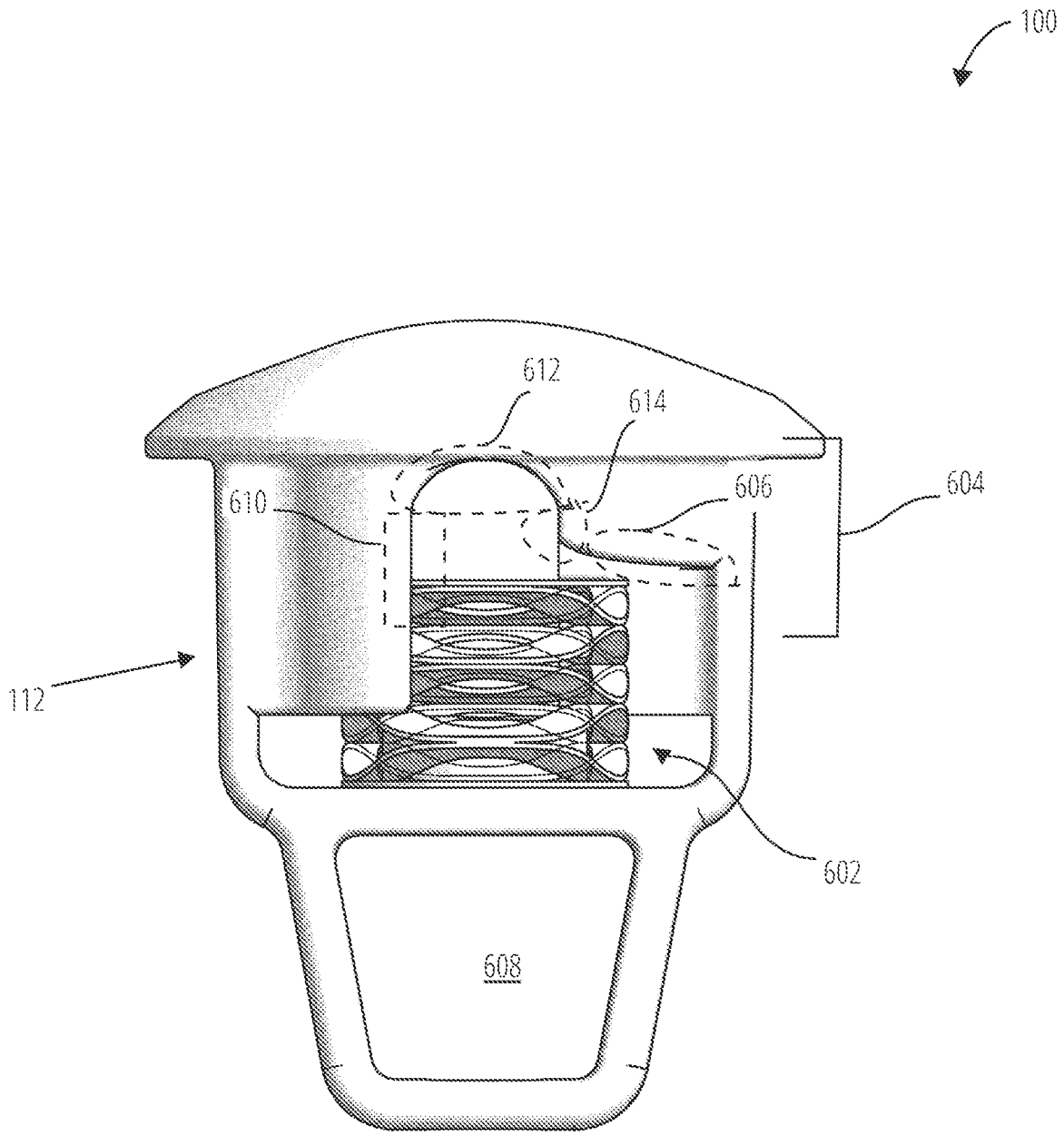
FIG. 6 illustrates a front view of an embodiment of a cable connection base cage.

FIG. 6 illustrates a front view of an embodiment of a cable connection base cage. The cable connection base cage (112). In one embodiment, a key (102) may be unlocked if it is pushed in and turned 90 degrees counterclockwise. The cage (112) may include a locking feature (604) comprising a ramp (606), edge (614), a seat (612), and a stop (610), that, in combination with a spring (602), enables the locking and unlocking functionality of key (102). That is, the biasing mechanism (602) may be arranged to urge the key (102) against the ramp (606) as the key is rotated so that key advances and drops into the groove. In one embodiment, the cage (112) includes a chamber (608) positioned opposite the keyhole (110). The chamber (608) may be accessible through a hole found on the bottom of the cage (112), which may align with a cable slot (502) found on the bottom of the ball (108). The chamber (608) may provide a mounting point for a cable and/or cable knot.

Figure 7:
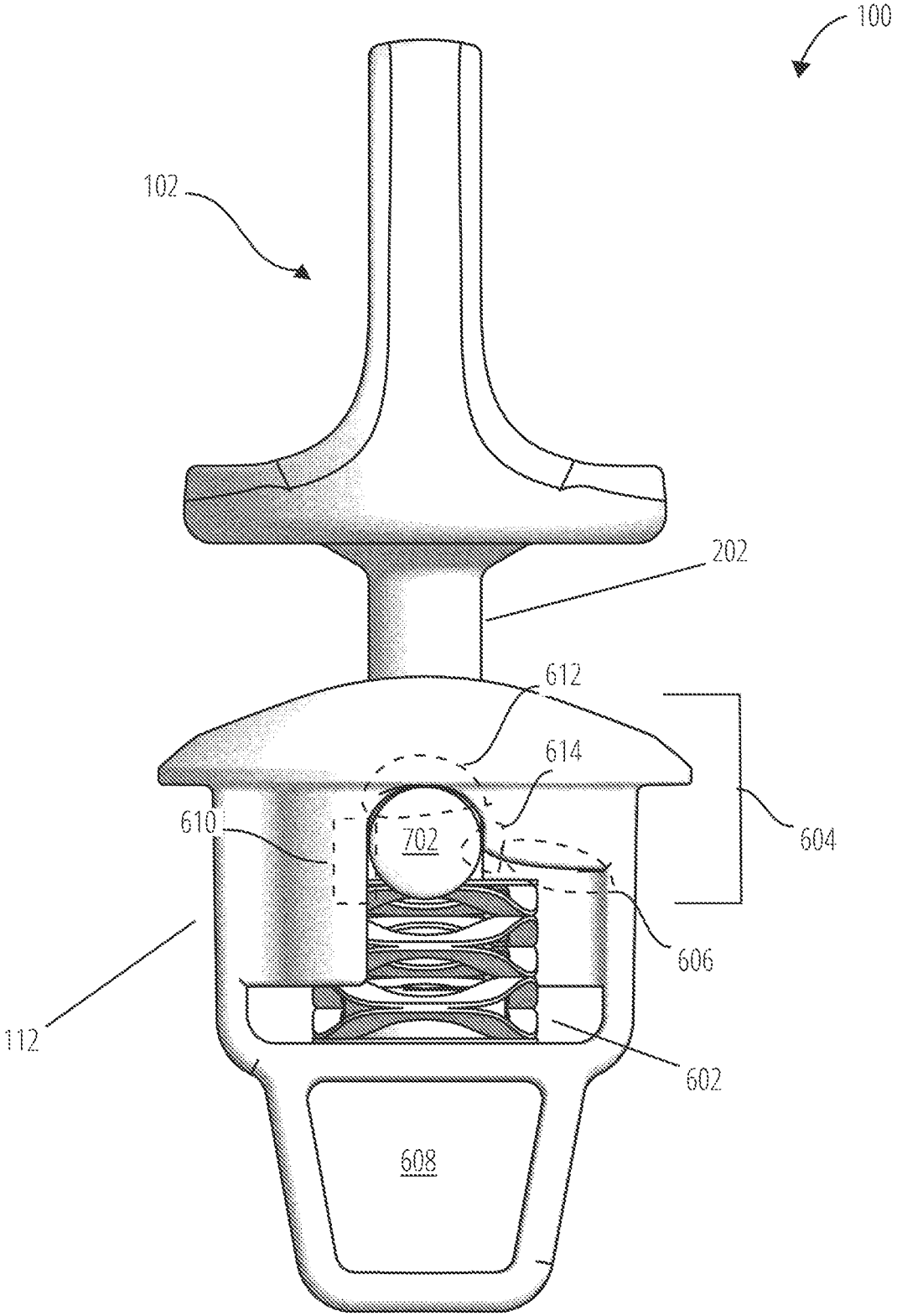
FIG. 7 illustrates a front view of an embodiment of a cable connection base cage and key.

FIG. 7 illustrates a front view of an embodiment of a cable connection base cage and key. A common aspect of the key (102) across all types of attachments is a locking bar (702) of the T-bar key. In one embodiment, the key (102) detachably couples to the ball (108) through the locking bar (702) extended from a neck (202). The locking bar (702) may traverse through a keyhole (110) of a cage (112) positioned within the ball (108). As shown also in FIG. 6, the cage (112) may include a locking feature (604) comprising a ramp (606), edge (614), a seat (612), and a stop (610), that, in combination with a biasing mechanism (602), enables the locking and unlocking functionality of key (102). The cage (112) may also include a chamber (608) providing a mounting point for a cable and/or cable knot.

Put another way, when a key (102) is rotated, the locking bar (702) moves across the ramp (606) towards the edge (614) and the spring (602) gradually compresses. When the locking bar (702) traverses past the edge (614), the spring (602) pushes the locking bar (702) along the stop (610) and into seat (612). The locking bar (702) is locked within the seat (612) by the spring (602) and prevented from rotating any further by the stop (610).

In one embodiment, the distance, as shown in FIG. 7, from the top of seat (612) to the point at which edge (614) begins to curve into ramp (606) is greater than half the diameter of the shape formed by the end of locking bar (702). This constraint prevents locking bar (702) from accidently being jostled, for example during vigorous exercise, to move along ramp (606) and thus be unlocked.

Figure 8:
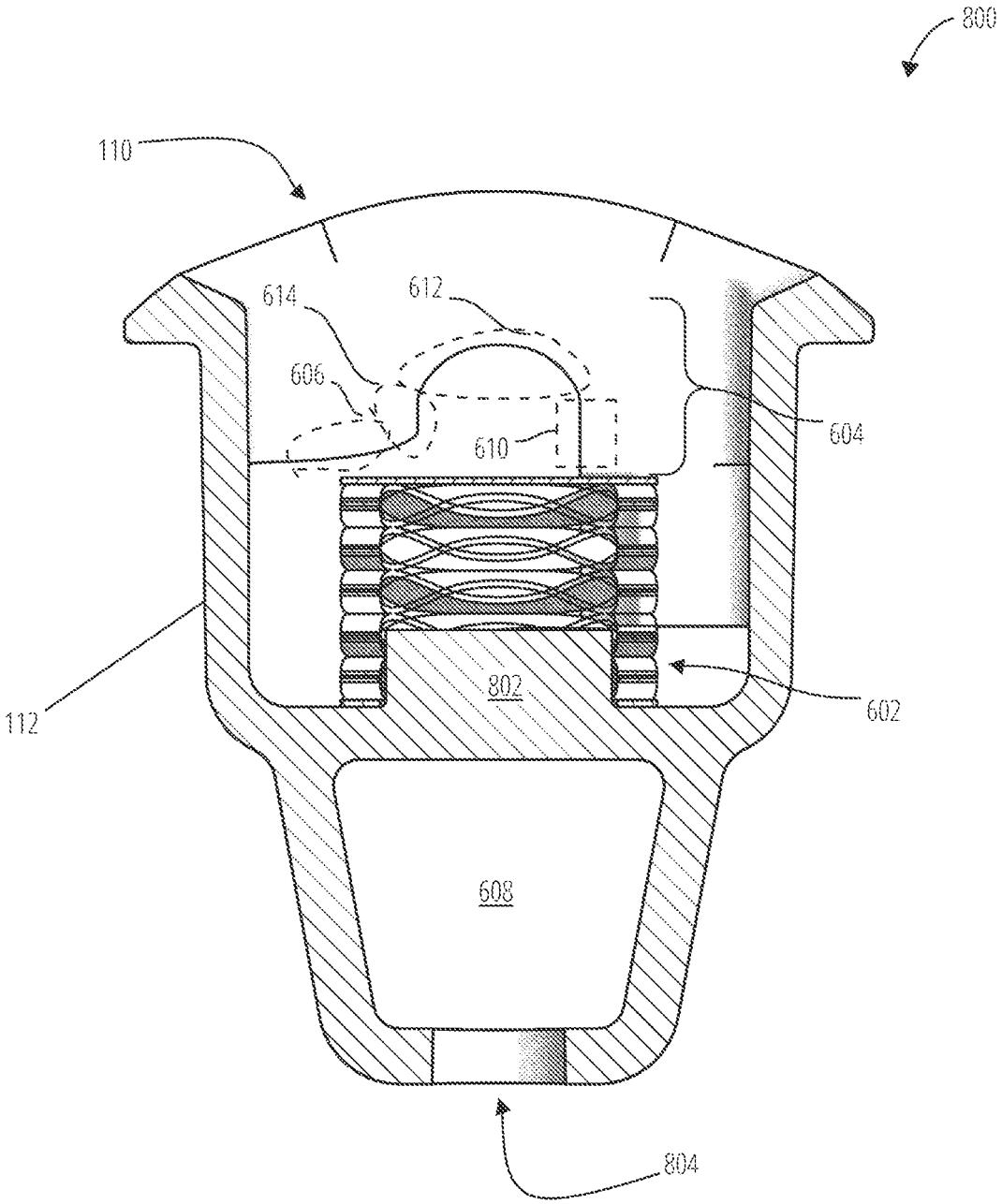
FIG. 8 illustrates a sectional view of an embodiment of a cable connection base cage.

FIG. 8 illustrates a sectional view of an embodiment of a cable connection base cage. The sectional view (800) of the cage (112) includes a perspective showing that a key (102) may be rotated 90 degrees to lock the locking bar (702) by engaging a recess within the cage (112). The locking bar (702) may be elastically retained within the cage (112) through a biasing mechanism such as a stacked wave spring (602) mounted on a coil mount (802). In some embodiments, for the biasing mechanism a conventional spring is used instead of a stacked wave spring, with or without a cap plate.

As shown also in FIG. 6, the cage (112) may include a locking feature (604) comprising a ramp (606), edge (614), a seat (612), and a stop (610), that, in combination with a biasing mechanism (602), enables the locking and unlocking functionality of key (102). The cage (112) may also include a chamber (608) providing a mounting point for a cable and/or cable knot. The chamber (608) may be accessible through a hole (804) found on the bottom of the cage (112).

Figure 9:
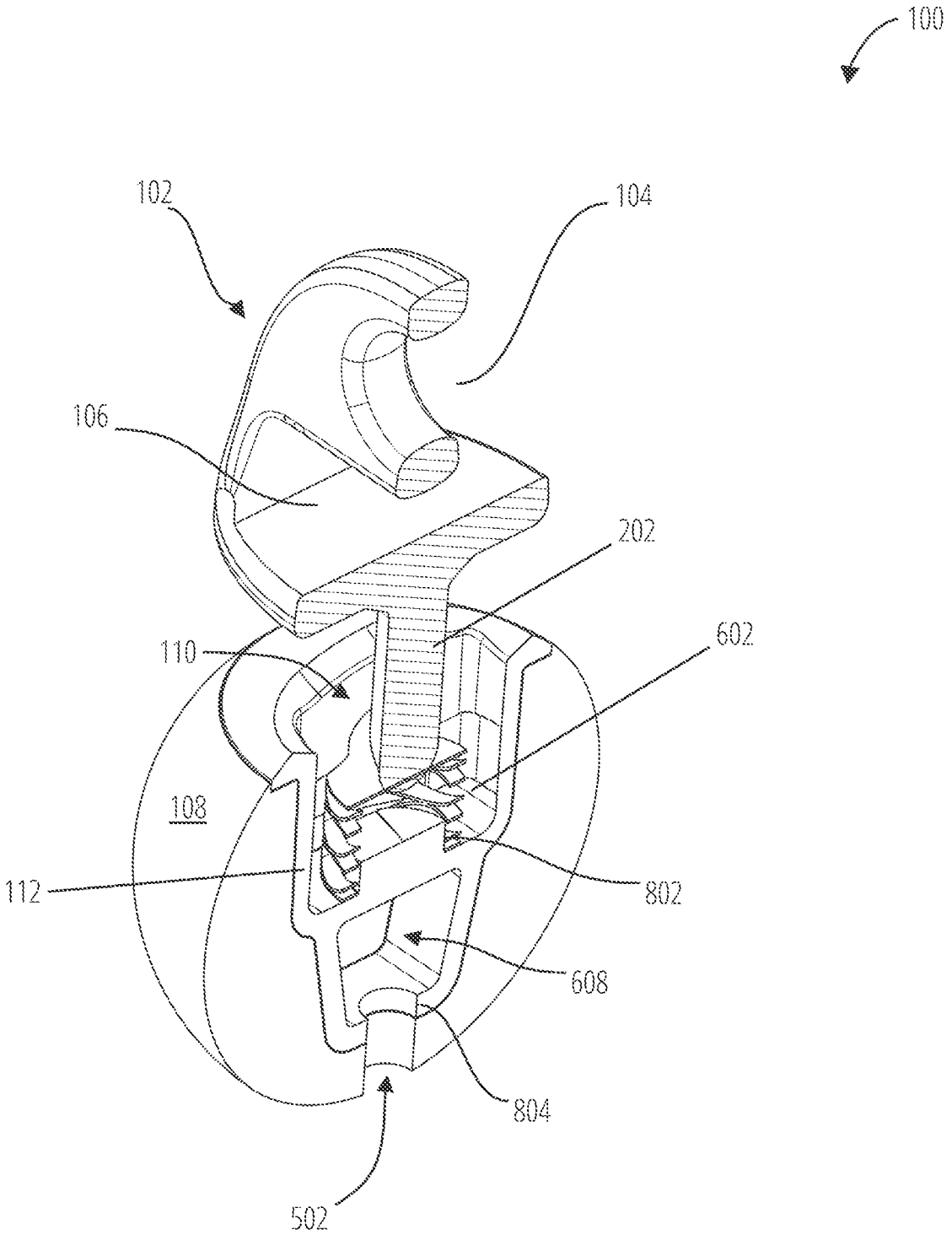
FIG. 9 illustrates a sectional perspective view of an embodiment of a cable connection base.

FIG. 9 illustrates a sectional perspective view of an embodiment of a cable connection base. As shown in both FIGS. 2 and 6, the exercise machine connector (100) includes a key (102) and a cable connection base (108). The key (102) includes a neck (202) of the keying mechanism. The neck (202) is coupled to the base (108) through a keyhole of a cage (112). The cage (112) may include a locking feature (604) comprising a ramp (606), edge (614), a seat (612), and a stop (610), that, in combination with a biasing mechanism (602) with coil mount (804), enables the locking and unlocking functionality of key (102).

In one embodiment, the cage (112) includes a chamber (608) positioned opposite the keyhole (110) relative to the coil mount (802). The chamber (608) may be accessible through a hole (804) found on the bottom of the cage (112). The hole (804) may align with a cable slot (502) found on the bottom of the ball (108). The chamber (608) and the hole (804) may provide a mounting point for a cable and cable knot. The cable may be threaded through the hole (804) by way of the cable slot (502).

In one embodiment, to secure a cable to the cable connection base (100), a cable is threaded through the cable slot (502) and the hole (804). The terminal end of the cable may then be knotted to prevent the cable from receding back through the cable slot (502) and the hole (804). The knot may be retained within the chamber (608) and resides in chamber (608) once the cage (112) is enclosed within the ball (108). In addition to securing a cable to the cable connection base (100), the positioning of the knot within the chamber (608) may serve as an anchor that secures the cage (112) to the ball (108).

Figure 10:
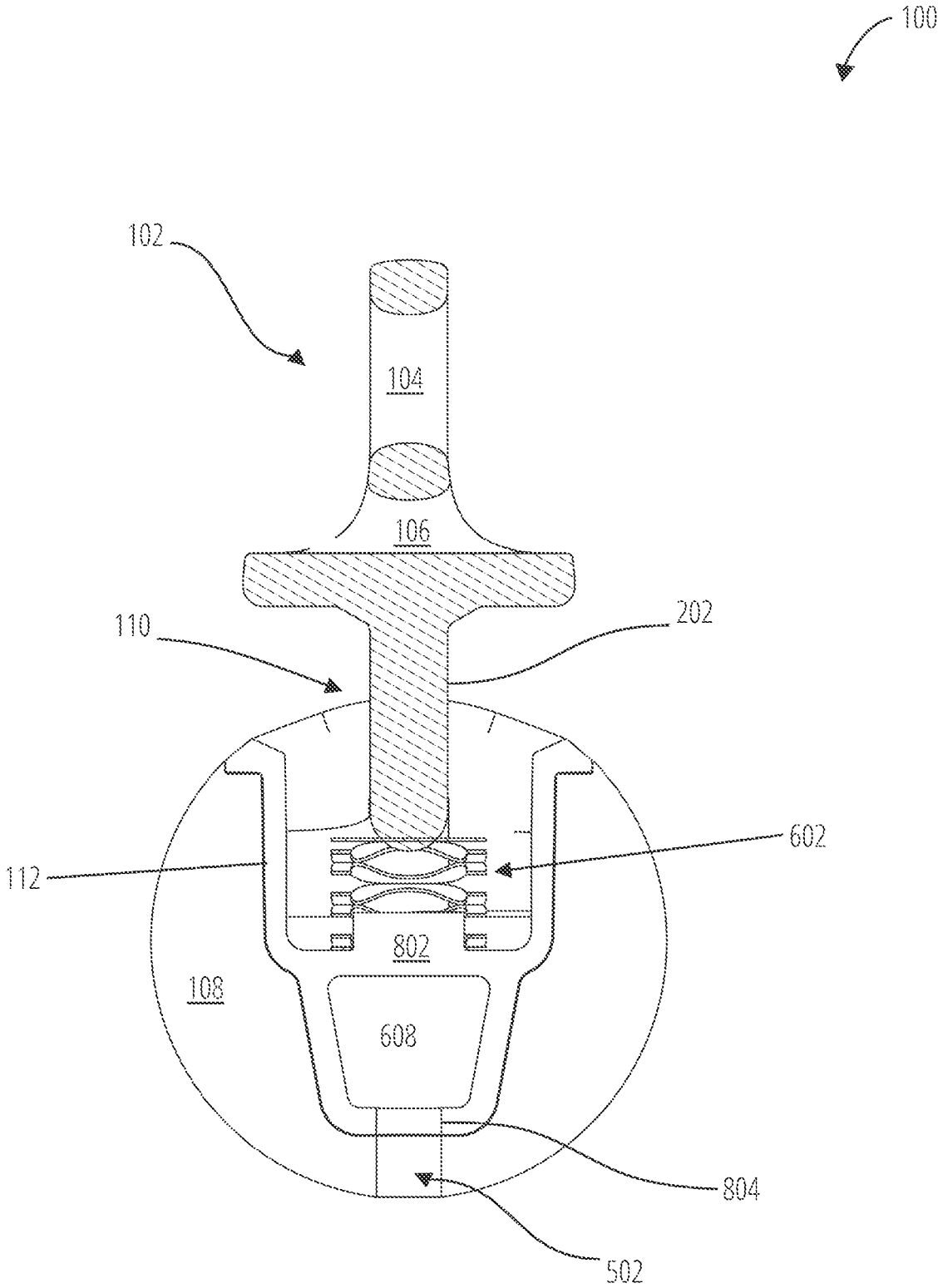
FIG. 10 illustrates a sectional view of an embodiment of a cable connection base.

FIG. 10 illustrates a sectional view of an embodiment of a cable connection base. As shown in both FIGS. 2 and 6, the exercise machine connector (100) includes a key (102) and a cable connection base (108). The key (102) includes a neck (202) of the keying mechanism. The neck (202) is coupled to the base (108) through a keyhole of a cage (112). The cage (112) may include a locking feature (604) comprising a ramp (606), edge (614), a seat (612), and a stop (610), that, in combination with a biasing mechanism (602) with coil mount (804), enables the locking and unlocking functionality of key (102). The cage (112) may include a chamber (608) accessible through a hole (804) found on the bottom of the cage (112). The hole (804) may align with a cable slot (502) found on the bottom of the ball (108).

Figure 11:
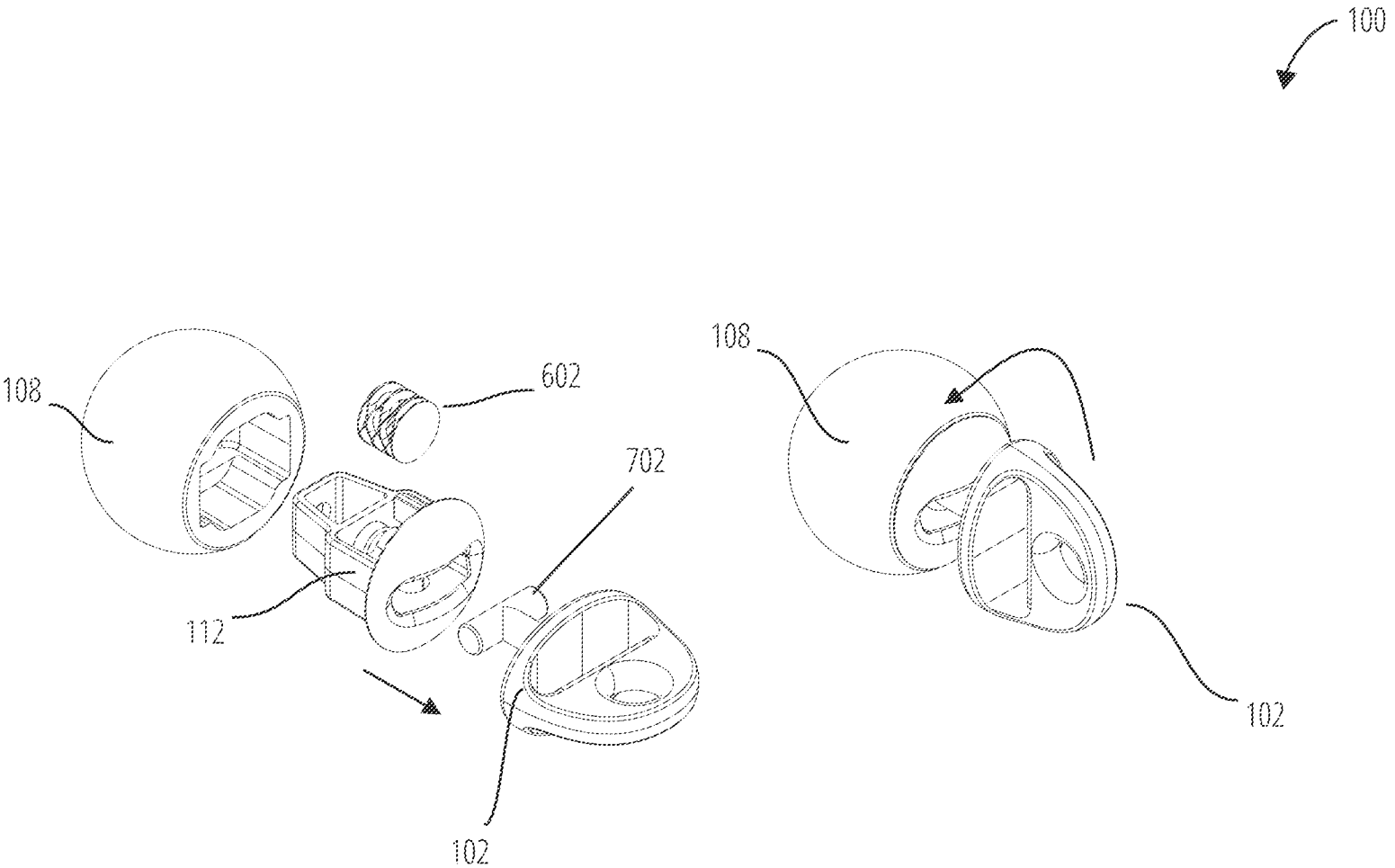
FIG. 11 illustrates an exploded view of an embodiment of a cable connection base.

FIG. 11 illustrates an exploded view of an embodiment of a cable connection base. In one embodiment, the ball (108) includes the cage (112) which provides an engagement point between the key (102) with locking bar (702) and the ball (108). The cage (112) may include a biasing mechanism, such as a spring (602). The spring (602) provides an elastic force to retain the locking bar (702) within the cage (112). In one embodiment, the key (102) only locks into the cage (112) when it is rotated 90 degrees clockwise, using a "push and turn to lock" paradigm. In the above configuration, the key may be unlocked if it is pushed in and turned 90 degrees counterclockwise.

In one embodiment, the diameter of locking bar (702) is in the range 3 mm to 30 mm. Further, the materials from which the cage (112) and key (102) may be made from any rigid materials including, without limitation, steel, aluminum, high strength plastic, and carbon fiber. Moreover, cage (112) and key (102) may be manufactured using any manufacturing method, including, without limitation, injection molding, casting, machining, forging, and 3D printing.

In one embodiment, a cable may not be attached to the cable connection base (100). In the aforementioned configuration, the cage (112) and the ball (108) may be coupled together through an anchor. The anchor may traverse through the cable slot (502) and the hole (804). The anchor may then retain the cage (112) to the body of the ball (108).

Figure 12:
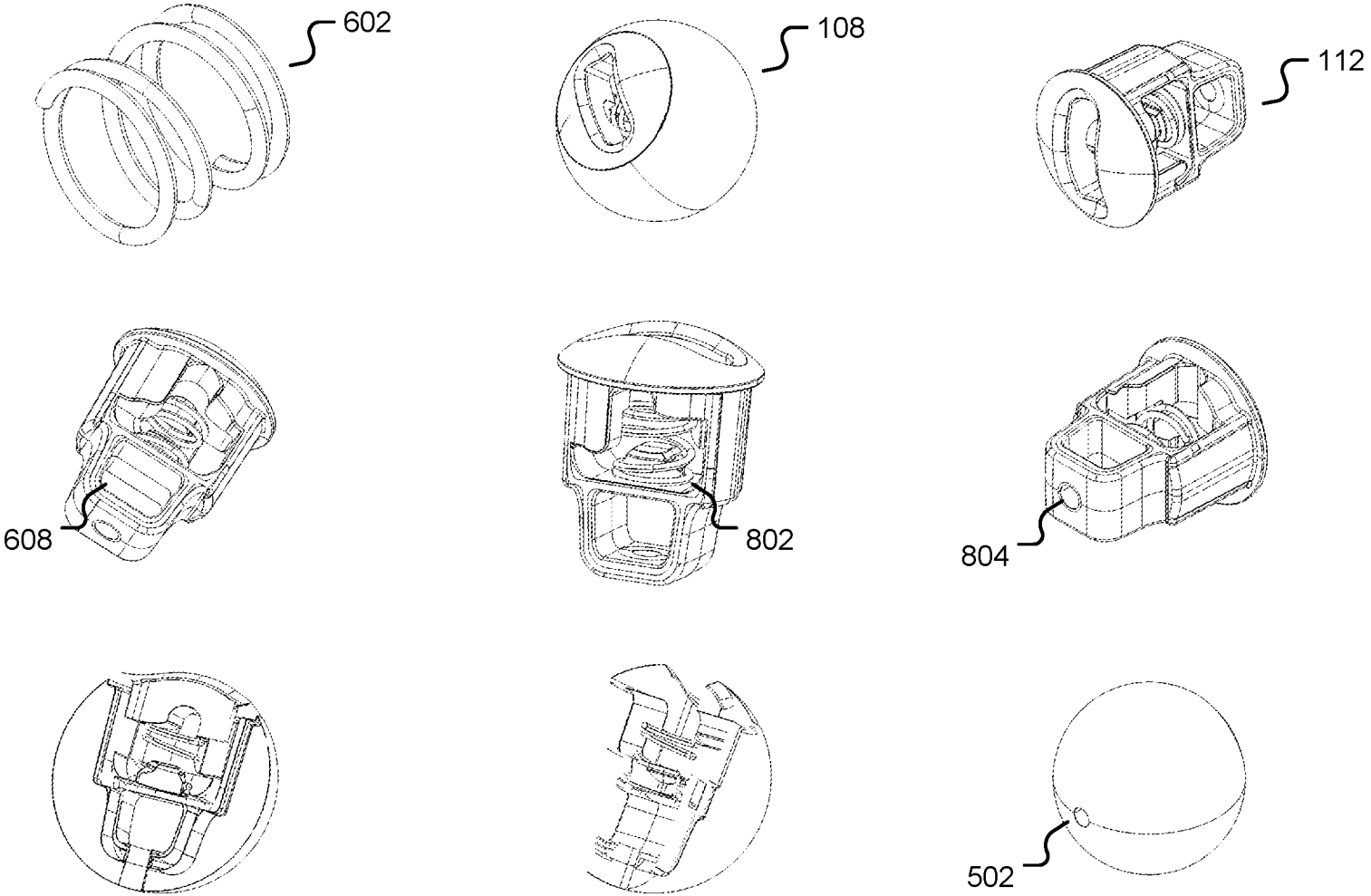
FIG. 12 illustrates several perspective views of an embodiment of a cable connection base.

FIG. 12 illustrates several perspective views of an embodiment of a cable connection base. Examples are given of a biasing mechanism (602), a base (108), a cage (112), a chamber (608), a coil mount (802), a chamber hole (804), and a base hole (502).

Figure 13:
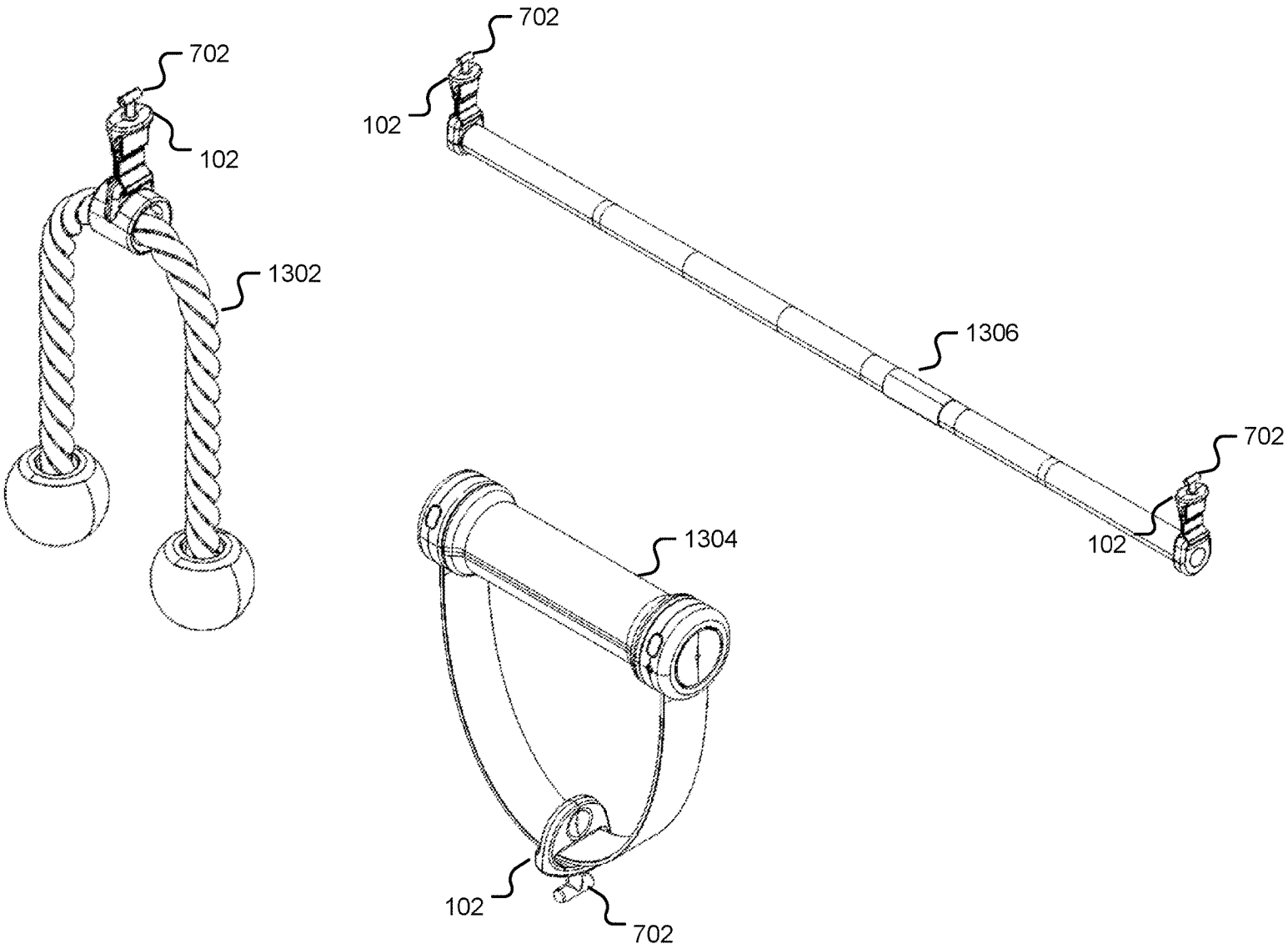
FIG. 13 illustrates three examples of an actuator including their respective keys.

FIG. 13 illustrates three examples of an actuator including their respective keys. Rope (1302) includes a key (102), which itself includes a locking bar (702). The user would use the key (102) to efficiently and safely couple the rope (1302) to a cable connection base/exercise machine as shown in FIGS. 1-12 to be able to pull the rope for exercise, for example for an exercise like a two-handed curl. Similarly, handle (1304) also includes a key (102) and respective locking bar (702) for a user to couple to a cable connection base/exercise machine. A handle may be useful for an exercise like a cable fly.

Bar (1306) is a long actuator that may be used with two hands and itself has two keys (102), each with a lock bar (702). On a two-armed exercise machine, each of the two keys (102) may be used to connect to each arm to provide a stable resistance with twice the resistance capacity, for example 200 lb each arm for 400 lb total. Such a bar (1306) may be useful for an exercise like a lat pulldown.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine connector, comprising:

a cable connection base adapted to attach to an end of a cable;

a chamber that resides within a body of the cable connection base and adapted to receive a key through an opening of the chamber, wherein the key includes an eyelet through which a fastener can be attached;

a biasing mechanism within the chamber; and a receiving groove within the chamber wherein the biasing mechanism biases the key against the receiving groove so that the key is securely fixed within the chamber.

2. The exercise machine connector of claim 1, wherein the chamber is open on a first side for the key and a second side for the cable.

3. The exercise machine connector of claim 1, wherein the key is received via a slot.

4. The exercise machine connector of claim 1, wherein the key is T-shaped.

5. The exercise machine connector of claim 1, wherein the biasing mechanism comprises a spring.

6. The exercise machine connector of claim 1, wherein the biasing mechanism is arranged to urge the key against a ramp as the key is rotated so that the key advances and drops into the receiving groove.

7. The exercise machine connector of claim 1, wherein the exercise machine connector prevents the end of the cable from being retracted inside an exercise machine.

8. The exercise machine connector of claim 1, wherein a knot in the cable attaches the exercise machine connector to the cable.

9. The exercise machine connector of claim 1, wherein the receiving groove and the biasing mechanism enable the key to rotate 90 degrees in one direction, but not rotate backwards in an opposite direction without pressure being applied through the key against the biasing mechanism, such pressure enabling backward rotation.

10. The exercise machine connector of claim 1, wherein the chamber includes a ramp, a seat, and an edge that constrain a rotational movement of the key.

11. An exercise machine connector, comprising:

a cable connection base adapted to attach to an end of a cable;

a chamber that resides within a body of the cable connection base and adapted to receive a key through an opening of the chamber;

a biasing mechanism within the chamber; and a receiving groove within the chamber wherein the biasing mechanism biases the key against the receiving groove so that the key is securely fixed within the chamber, wherein the exercise machine connector is substantially spherical in shape.

12. An exercise machine connector comprising:

a cable connection base adapted to attach to an end of a cable;

a chamber that resides within a body of the cable connection base and adapted to receive a key through an opening of the chamber, wherein the chamber comprises a flexible ball surrounding a rigid cage, wherein the rigid cage serves to attach the cable, and accommodate the key;

a biasing mechanism within the chamber; and a receiving groove within the chamber wherein the biasing mechanism biases the key against the receiving groove so that the key is securely fixed within the chamber.

13. An exercise machine, comprising:

an arm;

a cable extending from the arm; and a ball attached to an end of the cable having a slot accommodating a key formed as a t-shaped linkage, wherein the ball includes a chamber that resides within a body of the ball and is adapted to receive the key through an opening of the chamber.

14. The exercise machine of claim 13, further comprising an actuator, wherein the actuator is coupled to the ball.

15. The exercise machine of claim 13, wherein the ball prevents the end of the cable from being retracted inside the exercise machine.

16. A method of connecting an actuator to an exercise machine comprising:

connecting a cable to a cable connection base by attaching an end of the cable to the cable connection base;

receiving a key in a chamber connected to the cable connection base through an opening of the chamber, wherein the chamber resides within a body of the cable connection base; and biasing the key within the chamber against a receiving groove so that the key is securely fixed within the chamber.

17. The method of claim 16, wherein the chamber is open on a first side for the key and a second side for the cable.

18. The method of claim 16, wherein the key is t-shaped.

19. The method of claim 16, wherein the key is biased utilizing a spring.

* * * * *